US008552628B2

(12) United States Patent
Below

(10) Patent No.: US 8,552,628 B2
(45) **Date of Patent: *Oct. 8, 2013**

(54) HIGH THREAD SPARK PLUG WITH UNDERCUT INSULATOR

(75) Inventor: Matthew B. Below, Findlay, OH (US)

(73) Assignee: Fram Group IP LLC, Lake Forest, IL (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/252,364

(22) Filed: Oct. 4, 2011

(65) Prior Publication Data

US 2012/0325520 A1 Dec. 27, 2012

Related U.S. Application Data

(63) Continuation of application No. 12/752,694, filed on Apr. 1, 2010, now Pat. No. 8,030,831.

(60) Provisional application No. 61/407,716, filed on Oct. 28, 2010, provisional application No. 61/407,726, filed on Oct. 28, 2010.

(51) Int. Cl.
*H01T 13/20* (2006.01)

(52) U.S. Cl.
USPC ..... 313/141; 313/143; 313/144

(58) Field of Classification Search
USPC ..... 313/141, 144, 118, 132, 137, 143
See application file for complete search history.

(56) References Cited

U.S. PATENT DOCUMENTS

| | | | |
|---|---|---|---|
| 2,300,646 | A | 11/1942 | Buening |
| 2,894,315 | A | 7/1959 | Candelise |
| 5,091,672 | A | 2/1992 | Below |
| 5,697,334 | A | 12/1997 | Below |
| 5,918,571 | A | 7/1999 | Below |
| 6,104,130 | A | 8/2000 | Below |
| 2008/0272683 | A1 | 11/2008 | Boehler et al. |
| 2009/0079319 | A1 | 3/2009 | Boehler et al. |
| 2009/0121603 | A1 | 5/2009 | Below et al. |
| 2009/0189503 | A1 | 7/2009 | Below |
| 2009/0189505 | A1 | 7/2009 | Below |
| 2009/0189506 | A1 | 7/2009 | Below |

OTHER PUBLICATIONS

International Search Report for International Application No. PCT/US2011/030760 dated Nov. 23, 2011.

Written Opinion for International Application No. PCT/US2011/030760 dated Nov. 23, 2011.

International Preliminary Report on Patentability, PCT/US2011/030760, Oct. 11, 2012

*Primary Examiner* — Vip Patel

(74) *Attorney, Agent, or Firm* — Barnes & Thornberg LLP

(57) ABSTRACT

An assembly for a spark plug, the assembly having: an insulator, the insulator having a channel formed in an exterior surface of the insulator; and a jamb nut surrounding the insulator, the jamb nut being aligned with the channel such that a distal end of the jamb nut does not contact the insulator.

12 Claims, 2 Drawing Sheets

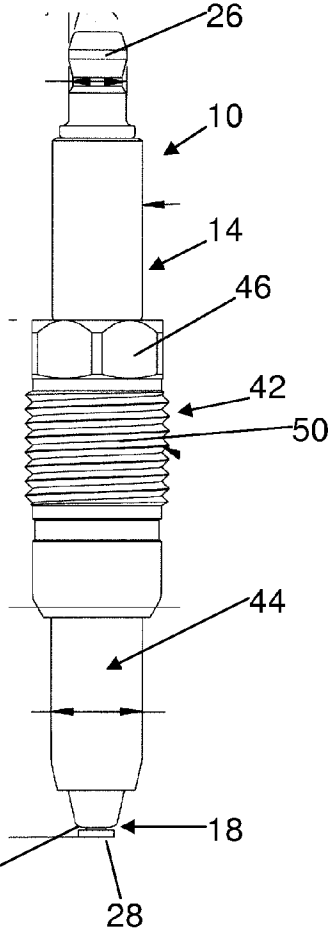
FIG. 2
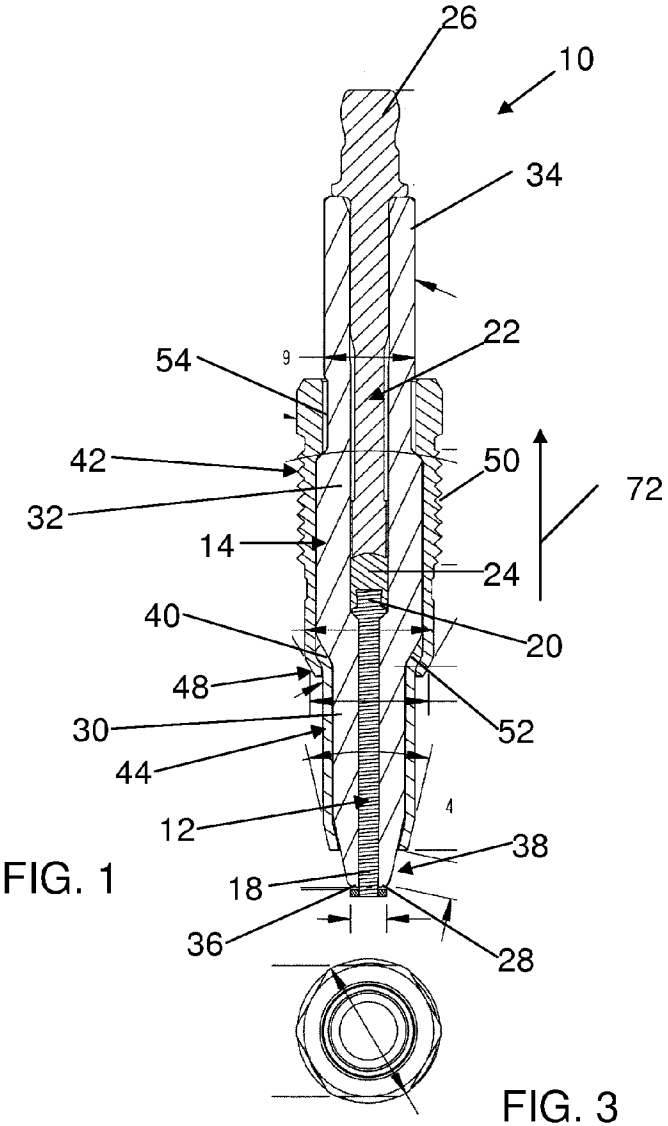
FIG. 1
FIG. 3

HIGH THREAD SPARK PLUG WITH UNDERCUT INSULATOR

CROSS REFERENCE TO RELATED APPLICATIONS

This application is a continuation of U.S. Ser. No. 12/752,694 filed Apr. 1, 2010, the contents of which are incorporated herein by reference thereto.

This application also claims the benefit of U.S. Provisional Patent Application Ser. Nos. 61/407,716 filed Oct. 28, 2010 and 61/407,726 filed Oct. 28, 2010, the contents each of which are incorporated herein by reference thereto.

BACKGROUND

This application relates generally to spark plugs for internal combustion engines and, more particularly, to a jamb nut to insulator interface that reduces loads on the spark plug insulator.

Traditional spark plug construction includes an annular metal casing having threads near one end and a ceramic insulator extending from the threaded end of the metal casing as well as beyond the opposite end of the metal casing. A central electrode extends through the insulation and is exposed near the threaded end. The central electrode is also electrically connected to a terminal that extends from an opposite end of the insulator. The terminal is configured to be attached to a spark plug ignition wire.

The force applied to seal the spark plug in the head of an engine block is the result of torque transmitted to the threaded metal casing; hence, the threaded portion of the metal casing must be sturdy and of substantial size. A portion of the metal casing is formed to have a jamb nut that is configured to be engaged by a socket tool to provide the torque to the threaded portion. The threaded portion is located away from the jamb nut which is engaged by the socket tool.

To facilitate the controlled and efficient exhaust of gases from a combustion chamber, the valves are sometimes increased in size. This may cause a decrease in the combustion chamber wall area available to threadedly receive the spark plug, which in turn may necessitate a decrease in the size of the bore receiving the spark plug, and in some instances an increase in the overall length of the spark plug. Accordingly, the spark plugs associated with these reduced size bores will also have a corresponding reduced diameter.

The decrease in the diameter of the spark plug may reduce the spark plugs ability to hold onto its ground shield during removal. A higher strength steel jamb nut may be used to combat this problem however, assembling a higher strength steel jamb nut to the insulator will result in higher loads being applied to the insulator during assembly.

Accordingly, the inventor herein has recognized that it is desirable to provide a jamb nut to insulator interface that reduces loads upon the insulator.

SUMMARY

Exemplary embodiments of the present invention relate to a spark plug for an internal combustion engine. The spark plug having an elongated center electrode having a center electrode tip at one end and a terminal proximate to another end of the center electrode; an insulator surrounding a portion of the center electrode, the insulator having a channel formed in an exterior surface of the insulator; and a jamb nut surrounding the insulator, the jamb nut being aligned with the channel such that a distal end of the jamb nut does not contact the insulator.

Exemplary embodiments of the present invention also relate to a method for forming a spark plug, the method including the steps of: inserting an insulator into an outer shell of the spark plug, the insulator having a first portion, a second portion and a third portion, the first portion being located at one end of the insulator and the third portion being located at an opposite end of the insulator and the second is located between the first end and the third end, wherein a channel is located between the second portion and the third portion and the second portion has a larger thickness than the first portion and the third portion, the insulator further comprising a shoulder portion located between the channel and the second portion; contacting the shoulder portion of the insulator with an inner shoulder portion of the outer shell proximate to a jamb nut of the outer shell, the inner shoulder and the jamb nut being configured to provide an air gap between the jamb nut and the channel such that no portion of the jamb nut directly contacts the insulator; and securing a ground shield between another shoulder portion of the insulator and a distal end of the outer shell, the another shoulder portion being located between the first portion and the second portion of the insulator.

In another embodiment, an assembly for a spark plug is provided, the assembly having: an insulator, the insulator having a channel formed in an exterior surface of the insulator; and a jamb nut surrounding the insulator, the jamb nut being aligned with the channel such that a distal end of the jamb nut does not contact the insulator.

BRIEF DESCRIPTION OF DRAWINGS

FIG. 1 is a cross-sectional view of a spark plug in accordance with an exemplary embodiment of the present invention;

FIG. 2 is a side view of the exemplary spark plug illustrated in FIG. 1;

FIG. 3 is a view along lines 3-3 of FIG. 1; and

DESCRIPTION OF EXEMPLARY EMBODIMENTS

Figure 4:
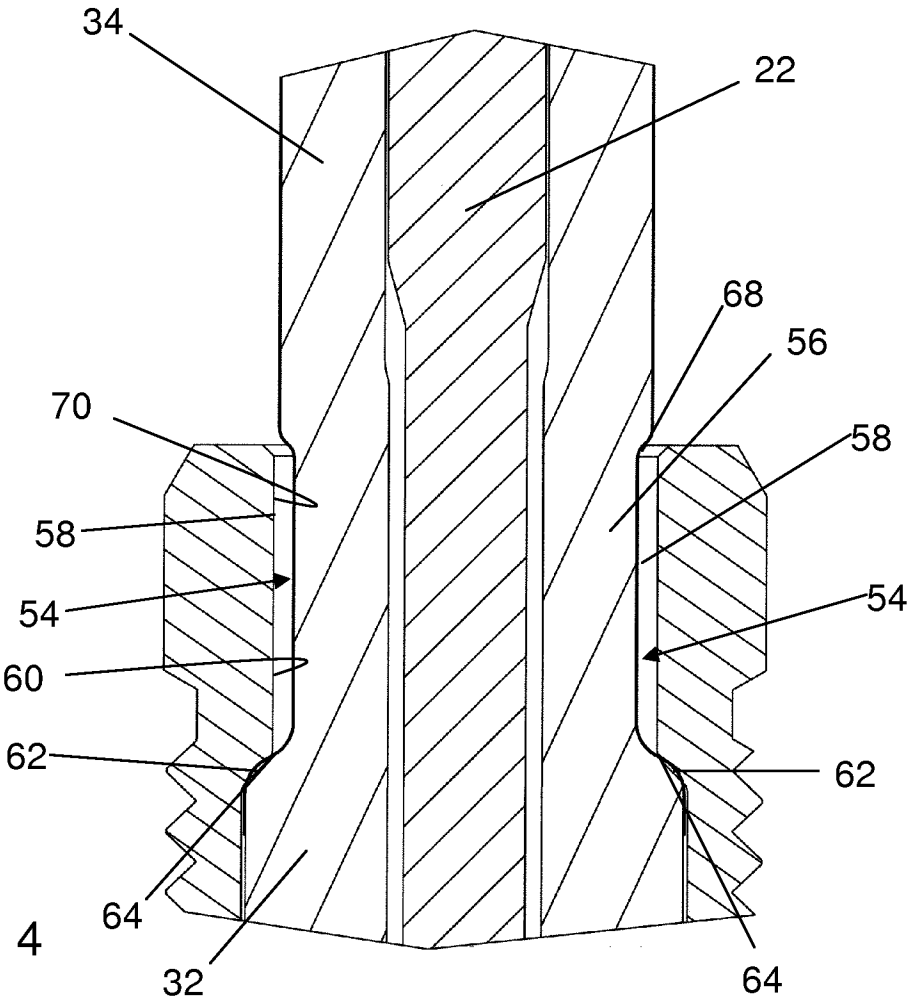
FIG. 4 is an enlarged view of a portion of FIG. 1.

FIGS. 1-4 illustrate an overall structure of an exemplary embodiment of the present invention and a spark plug 10 is illustrated. Spark plug 10 is designed for use in internal combustion engines. The installation of spark plug 10 into an internal combustion engine is achieved by configuring it so that a portion of the spark plug protrudes into a combustion chamber (not shown) of the engine through a threaded bore provided in the engine head (not shown). Spark plug 10 includes a cylindrical center electrode 12 that extends along an axial length of the spark plug and a ceramic or similarly comprised insulator 14 concentrically surrounds a portion of the center electrode 12. An outer shell 16 surrounds a portion of insulator 14.

In the illustrated embodiment, center electrode 12 has a cylindrical body with a tip 18 at one end and the end 20 of center electrode 12 opposing tip 18 is electrically connected to a cylindrical terminal stud 22 through an electrically conductive glass seal 24. Of course, other equivalent materials may be used to provide the conductive arrangement between end 20 and the terminal stud. In one embodiment, the electrically conductive glass seal can be a fired-in seal. The glass seal serves as the electrical connection between terminal stud and the center electrode. The terminal stud further comprises a terminal nut 26 that protrudes from the insulator and is configured to attach to an ignition cable (not shown) that supplies the electric current to the plug when the plug is installed. In an alternative embodiment, a resistive element may be disposed between the terminal stud and the center electrode.

The center electrode may comprise a core made of a highly heat conductive metal material such as, for example, copper, covered by a longer than conventional sheath made a highly heat-resistant, corrosion-resistant metal material such as, for example, Inconel, another nickel-based alloy, or other suitable metal or metal alloy. Still further, the center electrode will have a noble metal chip 28, such as one made from a gold, palladium, or platinum alloy in any suitable form for enabling proper spark plug functioning such as, for example, flat or finewire, that is joined to center electrode tip 18 to improve heat transfer and maintain the sparking gap. As is known in the related arts, the terminal stud can comprise steel or a steel-based alloy material with any suitable finish such as but not limited to a nickel-plated finish.

As illustrated, the insulator has an elongated, substantially cylindrical body with a first 30, a second 32, and a third 34 insulator sections each having different diameters. The first insulator section substantially surrounds the center electrode and terminates at a distal end 36 that has a tapered or flared configuration 38. The second insulator section is located intermediate first and third insulator sections and the diameter of the second insulator section is greater than that of either of the other two insulator sections. The second insulator section and the narrower first insulator section are separated from each other by a shoulder portion 40.

The spark plug further comprises an outer shell 42 and a ground shield 44. The outer shell further comprises a jamb nut portion 46 at one end and a motor seat portion 48 at an opposite end. Located between the jamb nut portion and the motor seat portion is a plurality of threads 50 that are configured to threadingly engage a threaded portion of a generally cylindrical opening that is in communication with the combustion chamber of an internal combustion engine. The threaded portion of the outer shell is configured to surround the second section of the insulator. The jam nut portion is integrally formed with the outer shell such that the spark plug can be removed in a helical pattern as the jam nut is unscrewed, resulting in easy, direct removal with negligible tipping. A suitable socket tool can engage the jam nut of the outer shell for screwing the spark plug into and out of the engine bore.

The motor seat portion of the outer shell includes a flared portion that is situated below the threaded section of the outer shell and overlaps a complimentary flared section 52 of the ground shield in juxtaposed alignment with shoulder portion 40 of the insulator when the spark plug assembly is complete. At this juncture, the ground shield and the outer shield are secured together, with the insulator being captured therein.

Referring now in particular to FIGS. 1 and 4, the insulator further comprises a channel 54 formed in the exterior surface of the insulator, the channel provides a section 56 of the insulator located between the second portion and the third portion of the insulator. Section 56 has a reduced thickness such that is smaller than adjacent portions of the second section and the third section. In addition, the channel is located such that it is aligned with the jamb nut portion of the outer shell when the insulator is secured to the outer shell and ground shield. Channel 54 is further configured to provide a gap 58 between an inner surface 60 of the outer shell behind the jamb nut and the outer surface of the insulator defined by the channel. This gap prevents the jamb nut from directly contacting the insulator on the barrel surface of the insulator located on third section of the insulator located above the channel and thus changes the load the jamb nut transfers to the insulator. In prior designs the jamb nut was allowed to directly contact the insulator right at the barrel interface which creates very high stresses in the insulator radius allowing it to break at lower impacts.

Moreover and by removing this point of contact higher strength outer shells with an integral steel jamb nut portion can be used since the higher crimping compressive forces required for the higher strength steel outer shells do not produce a large tension load on the ceramic insulator which results in an insulator more resistant to impacts. Non-limiting examples of high strength steels are those with an increased amount of carbon or stainless steel in order to provide the desired qualities. Non-limiting examples of high strength steels are those manufactured according to the following standards, ASTM A1008; and ASTM A1014-1019.

Accordingly and as discussed above, the back side of the jamb nut portion does not make contact with the barrel surface of the insulator thus this changes how stresses are applied to the ceramic namely, the jamb nut reduces stresses to the insulator in the open area behind the jamb nut. For example, the jamb nut will not apply forces perpendicular to or at an angle to the tensional loads in the ceramic due to the securement or "hot pressing" of the outer shell to the insulator. Thus, the ceramic is less likely to fatigue or break due to forces being applied at an angle to the tensional loads in the ceramic by the jamb nut. In addition, the higher strength outer shell increases the high thread spark plugs ability to hold onto its ground shield during removal.

Proximate to the jamb nut and thread interface of the outer shell is an inner shoulder portion 62 that is configured to engage a complimentary shoulder portion 64 of the insulator. As illustrated, shoulder portion 64 is located between channel portion 54 and second portion 32 of the insulator.

At the opposite end of the channel, the thickness of the insulator wall increases at a point 68 that extends past an opening 70 defined by the jamb nut portion. Thereafter, the third insulator section protrudes from the jamb nut of the outer shell.

During assembly, the insulator is inserted axially into the outer shell in the direction of arrow 72 then the motor seat portion 48 is pressed over flared portion 52 of the ground shield such that the insulator is captured within the assembly of the outer shell and the ground shield via shoulders 64 and 40 of the insulator.

Thereafter and when the spark plug is threaded into the engine bore via the jamb nut, there is no direct contact of the jamb nut with the insulator at the barrel interface. The motor seat portion will, in turn, engage a complimentary sealing seat portion of the engine bore (not shown) and thus establish an electrical ground connection between ground shield and the engine head while at the same time sealing the combustion chamber from the surrounding environment.

The assembled outer shell and ground shield thus function as a unit. In alternative configurations, the motor seat portion of the outer shell and portion 52 of the ground shield can also be joined to one another using a joining technique such as brazing, laser welding, resistance welding, or plasma welding, to secure the ground shield and the retainer together. In exemplary embodiments of the present invention, the motor seat portion of the outer shell can be "hot pressed" onto the flared portion of the ground shield. In addition, the ground shield may also comprise a ground strap with a ground electrode that extends over the center electrode tip. Moreover, the spark plug may also have various other configurations. Non-limiting examples of spark plug and ground shield/strap configurations are found in the following U.S. Pat. Nos. 5,091,672; 5,697,334; 5,918,571; and 6,104,130 and U.S. Patent Publications US 2008/0272683; US 2009/0079319; US 2009/0121603; US 2009/0189503; US 2009/0189505; and US 2009/0189506 the contents each of which are incorporated herein by reference thereto.

The outer shell will comprise a conductive metal material such as a nickel-plated, carbon steel-based alloy and the threaded section can have an outer thread diameter of about 12-16 mm or less; and the non-threaded section can have an outer diameter of about 6-10 mm to provide a small diameter spark plug thereby allowing for a greater amount of engine space as described above.

The shape, size, and particular construction of outer shell may, of course, vary greatly from one design to another; hence, the aforementioned dimensional attributes of the outer shell and spark plug are merely provided as non-limiting examples and exemplary embodiments of the present invention contemplate sizes greater or less than these values.

Still further, noble metal chips can be joined to the center electrode tip and a ground electrode strap by any suitable joining technique such as brazing, laser welding, resistance welding, or plasma welding.

The insulator is formed from a non-conducting ceramic material such as, for example, alumina ceramic so that it may fixedly retain center electrode while preventing an electrical short between the center electrode and the ground shield. Of course, any other suitable equivalent materials may be used.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. An assembly for a spark plug, comprising:

an insulator, the insulator having a channel formed in an exterior surface of the insulator; and a jamb nut surrounding the insulator, the jamb nut being aligned with the channel such that a distal end of the jamb nut does not contact the insulator.

2. The assembly as in claim 1, wherein no portion of the jamb nut makes direct contact with the insulator barrel.

3. The assembly as in claim 2, wherein the insulator has a first portion, a second portion and a third portion, the first portion being located at one end of the insulator and the third portion being located at an opposite end of the insulator, wherein the channel is located between the second portion and the third portion and the second portion has a larger thickness than the first portion and the third portion.

4. The assembly as in claim 1, wherein the jamb nut is integrally formed with an outer shell that surrounds a portion of the insulator and an exterior surface of the outer shell proximate to the jamb nut has a threaded portion.

5. The assembly as in claim 4, wherein the jamb nut is located on one end of the outer shell and an opposite end of the outer shell defines a motor seat portion of the outer shell, wherein the threaded portion is located between the jamb nut and the motor seat portion.

6. The assembly as in claim 5, wherein the insulator has a first portion, a second portion and a third portion, the first portion being located at one end of the insulator and the third portion being located at an opposite end of the insulator, wherein the channel is located between the second portion and the third portion and the second portion has a larger thickness than the first portion and the third portion.

7. The assembly as in claim 6, wherein the insulator further comprises a shoulder portion located between the channel and the second portion the shoulder portion being configured to engage an inner shoulder portion of the outer shell proximate to the jamb nut and thread interface of the outer shell.

8. The assembly as in claim 7, wherein the jamb nut forms an opening and the channel extends from the inner shoulder of the outer shell towards the distal end of the jamb nut forming the opening and thereafter the thickness of the insulator increases to provide the third portion of the insulator.

9. The assembly as in claim 8, wherein no portion of the jamb nut extending from the inner shoulder of the outer shell towards the distal end of the jamb nut makes direct contact with the insulator.

10. The assembly as in claim 9, wherein the insulator is made from a non-conducting ceramic material.

11. The assembly as in claim 9, wherein the insulator further comprises another shoulder portion located between the first portion and the second portion, the another shoulder portion being configured to engage a distal end of a ground shield located between the motor seat portion of the outer shell and the another shoulder portion.

12. The assembly as in claim 11, wherein the jamb nut forms an opening and the channel extends from the inner shoulder past a distal end of the jamb nut forming the opening and thereafter the thickness of the insulator increases to provide the third portion of the insulator.

* * * * *